US010870035B2

(12) United States Patent
Olmstead

(10) Patent No.: US 10,870,035 B2
(45) Date of Patent: Dec. 22, 2020

(54) CORE STRENGTHENING ASSEMBLY

(71) Applicant: Richard Olmstead, Windsor Locks, CT (US)

(72) Inventor: Richard Olmstead, Windsor Locks, CT (US)

( * ) Notice: Subject to any disclaimer, the term of this patent is extended or adjusted under 35 U.S.C. 154(b) by 41 days.

(21) Appl. No.: 16/296,764

(22) Filed: Mar. 8, 2019

(65) Prior Publication Data

US 2020/0282259 A1 Sep. 10, 2020

(51) Int. Cl.

| | |
|---|---|
| ***A63B 23/02*** | (2006.01) |
| ***A63B 21/00*** | (2006.01) |
| ***A63B 69/00*** | (2006.01) |
| ***A63B 43/02*** | (2006.01) |
| ***A63B 23/12*** | (2006.01) |
| *A63B 41/08* | (2006.01) |

(52) U.S. Cl.

CPC ..... *A63B 23/0205* (2013.01); *A63B 21/0004* (2013.01); *A63B 21/4034* (2015.10); *A63B 21/4035* (2015.10); *A63B 21/4043* (2015.10); *A63B 21/4049* (2015.10); *A63B 23/0238* (2013.01); *A63B 23/1236* (2013.01); *A63B 43/02* (2013.01); *A63B 69/0057* (2013.01); *A63B 21/00178* (2013.01); *A63B 21/4033* (2015.10); *A63B 41/08* (2013.01); *A63B 2208/02* (2013.01)

(58) Field of Classification Search

CPC ..... A63B 21/0004; A63B 21/4034; A63B 21/4035; A63B 21/4043; A63B 21/4049; A63B 21/00178; A63B 21/4033; A63B 23/0205; A63B 23/0238; A63B 23/1236; A63B 43/02; A63B 69/0057; A63B 2208/02; A63B 22/16; A63B 23/003; A63B 41/08

See application file for complete search history.

(56) References Cited

U.S. PATENT DOCUMENTS

| | | | | |
|---|---|---|---|---|
| 5,735,776 | A | 4/1998 | Swezey | |
| 6,475,125 | B1 * | 11/2002 | Roberts | A63B 43/007 482/121 |
| 7,303,512 | B1 * | 12/2007 | Goldman | A63B 21/0004 472/135 |
| 7,407,465 | B1 | 8/2008 | Alzamora | |
| 7,678,027 | B2 * | 3/2010 | Sanghavi | A63B 21/0023 482/75 |
| 8,235,878 | B2 * | 8/2012 | Signorile | A63B 26/003 482/142 |
| 8,353,808 | B1 | 1/2013 | Barney | |
| 8,357,077 | B2 * | 1/2013 | Taylor | A63B 26/003 482/139 |
| 8,550,965 | B2 | 10/2013 | Candela | |

(Continued)

FOREIGN PATENT DOCUMENTS

WO WO1999051309 10/1999

*Primary Examiner* — Megan Anderson

(57) ABSTRACT

A core strengthening assembly for performing core strengthening exercises includes a ball that may be positioned on a support surface. A harness is positioned around the ball and the ball rotates freely in the harness. A pair of pedals is each removably coupled to the harness. Each of the pedals may have one of a user's feet positioned thereon. In this way the user's feet are spaced from the support surface when the user performs core strengthening exercises.

12 Claims, 3 Drawing Sheets

(56) References Cited

U.S. PATENT DOCUMENTS

| | | | | |
|---|---|---|---|---|
| D724,159 | S | 3/2015 | Huber | |
| 9,079,072 | B2 * | 7/2015 | Agostini | A63B 22/18 |
| 9,327,155 | B2 | 5/2016 | Doyle | |
| 9,545,534 | B2 * | 1/2017 | Crandall | A63B 23/03525 |
| 9,993,685 | B2 * | 6/2018 | Stevens | A63B 22/18 |
| 2015/0217161 | A1 | 8/2015 | Taylor | |

* cited by examiner

CORE STRENGTHENING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to strengthening devices and more particularly pertains to a new strengthening device for performing core strengthening exercises.

BRIEF SUMMARY OF THE INVENTION

An embodiment of the disclosure meets the needs presented above by generally comprising a ball that may be positioned on a support surface. A harness is positioned around the ball and the ball rotates freely in the harness. A pair of pedals is each removably coupled to the harness. Each of the pedals may have one of a user's feet positioned thereon. In this way the user's feet are spaced from the support surface when the user performs core strengthening exercises.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
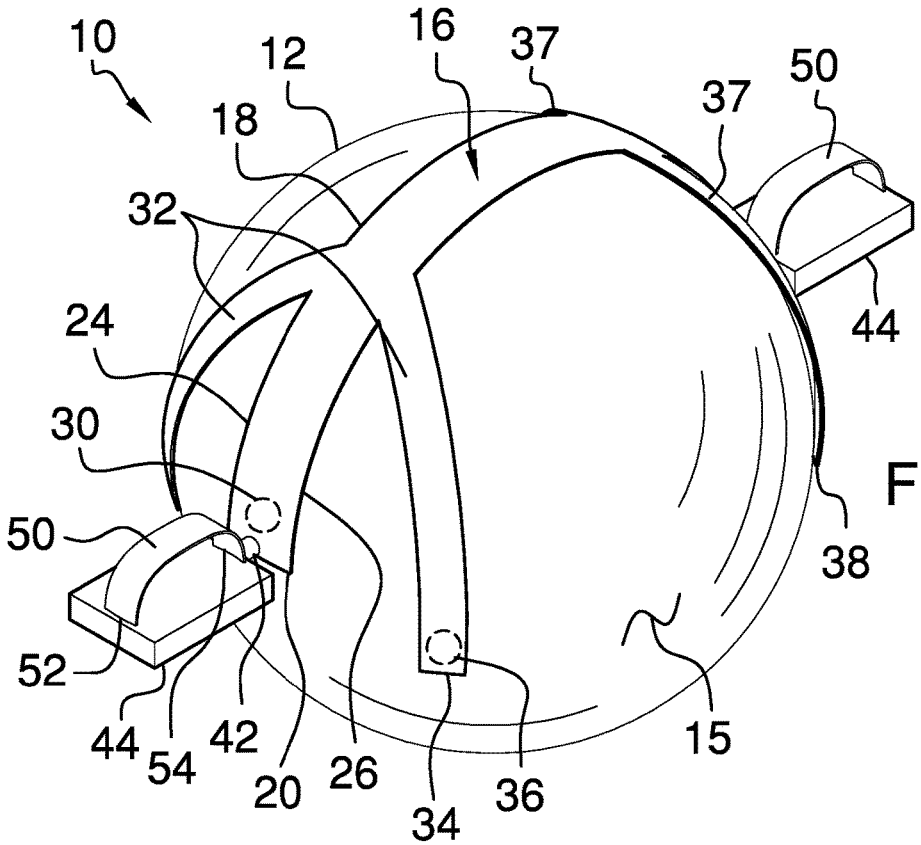
FIG. 1 is a perspective view of a core strengthening assembly according to an embodiment of the disclosure.
Figure 2:
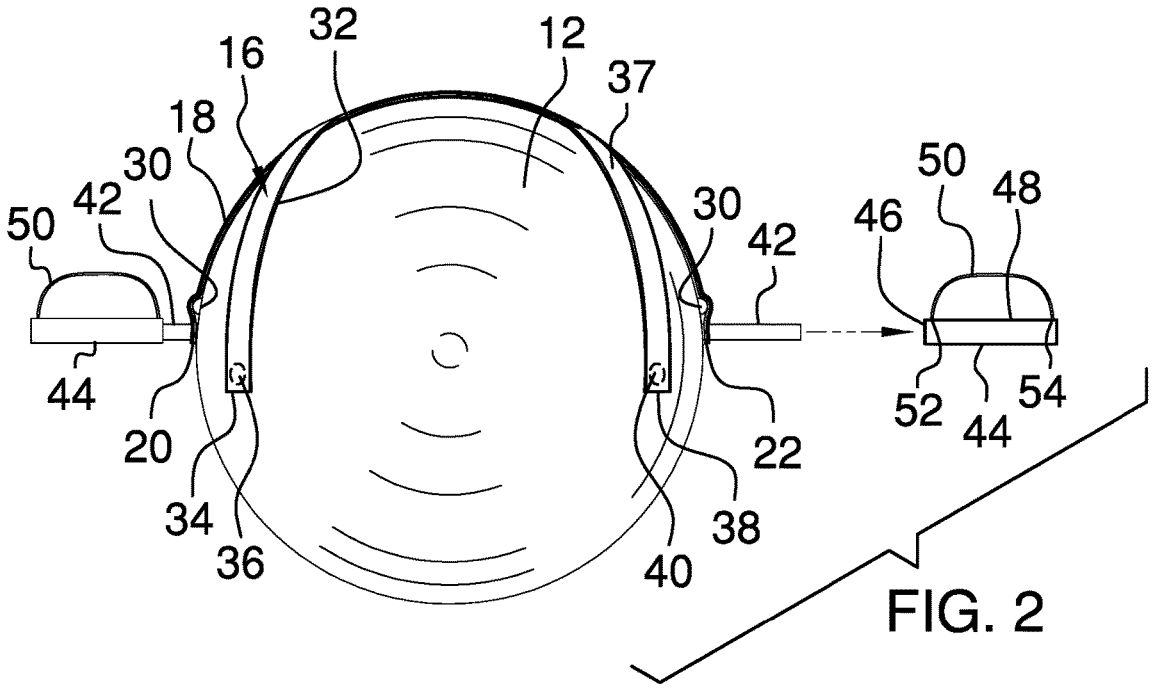
FIG. 2 is a front view of an embodiment of the disclosure.
Figure 3:
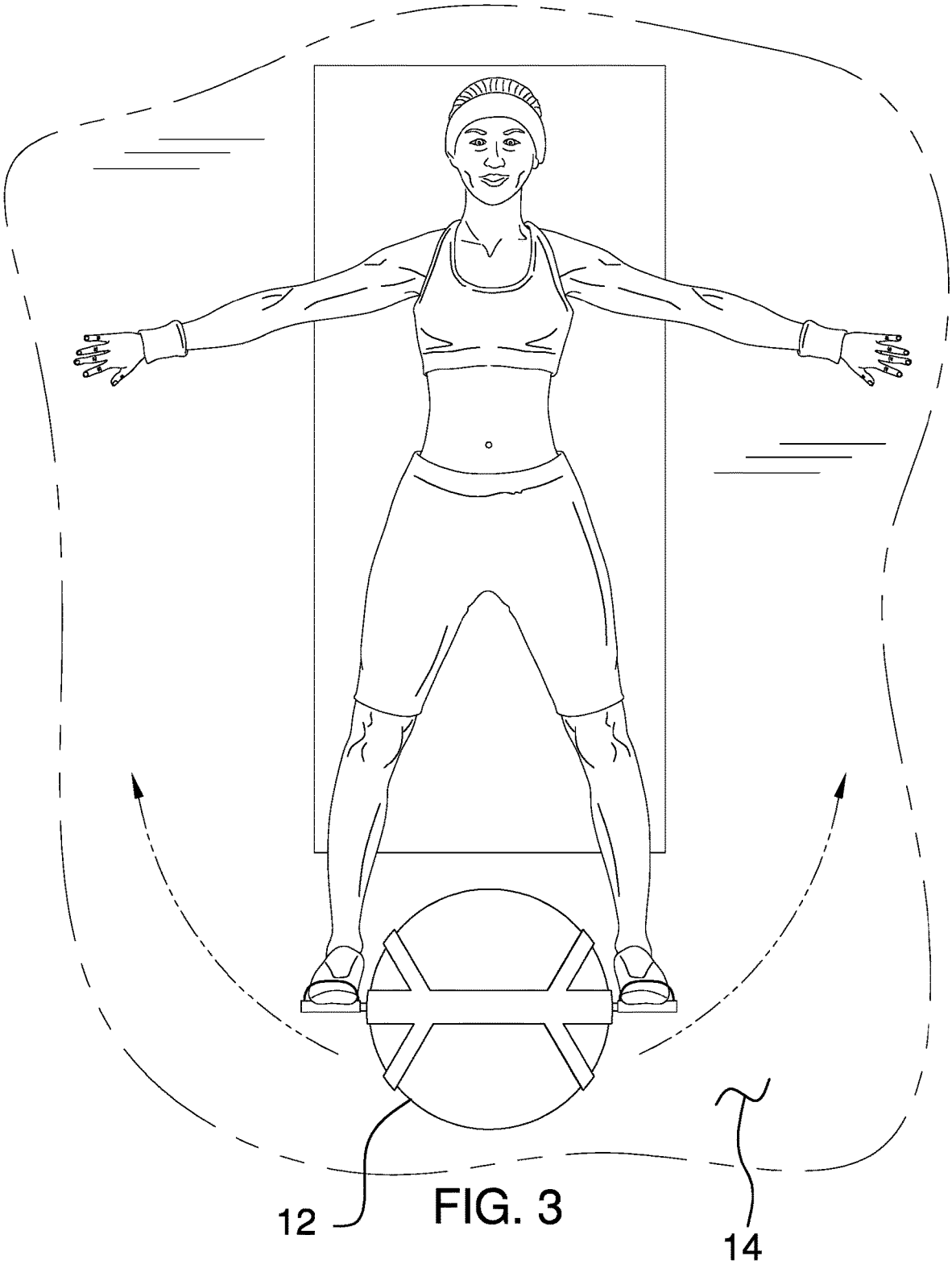
FIG. 3 is a top perspective in-use view of an embodiment of the disclosure.
Figure 4:
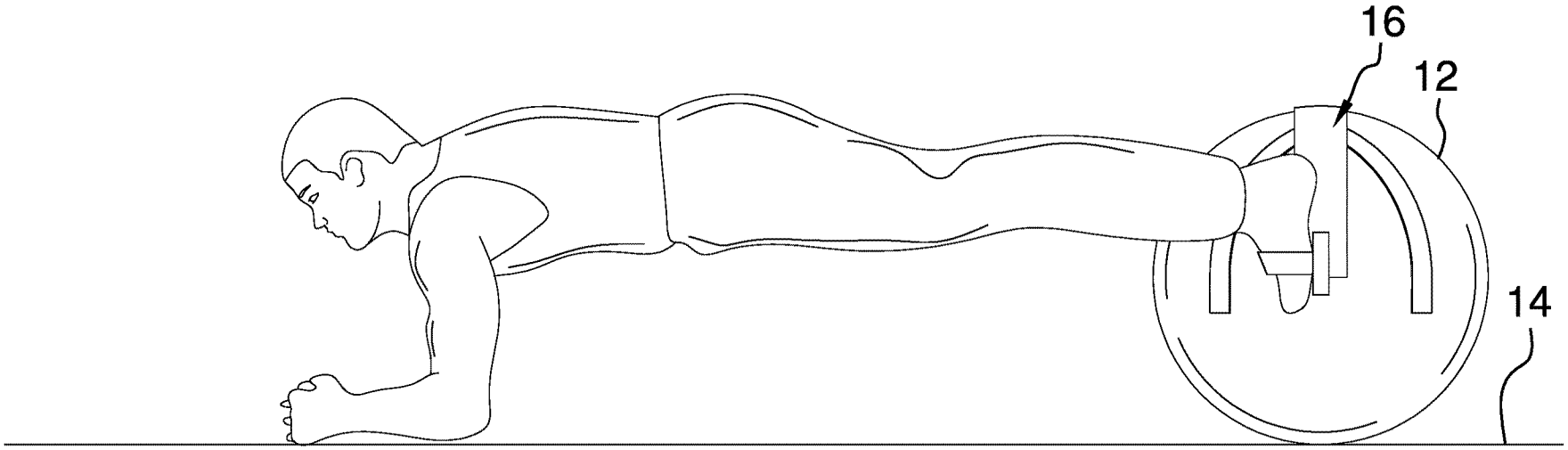
FIG. 4 is a perspective in-use view of an embodiment of the disclosure.

With reference now to the drawings, and in particular to FIGS. 1 through 4 thereof, a new strengthening device embodying the principles and concepts of an embodiment of the disclosure and generally designated by the reference numeral 10 will be described.

As best illustrated in FIGS. 1 through 4, the core strengthening assembly 10 generally comprises a ball 12 that may be positioned on a support surface 14 such as a floor or the like. The ball 12 has an outer surface 15 and a harness 16 is positioned around the ball 12. The ball 12 rotates freely in the harness 16. The ball 12 may have a diameter ranging between approximately 45.0 cm and 75.0 cm.

The harness 16 comprises a first member 18 that has a first end 20, a second end 22, a first lateral edge 24 and a second lateral edge 26. The first member 18 is elongated between the first 20 and second 22 ends. The first member 18 is concavely arcuate between the first 20 and second 22 ends. Moreover, the first member 18 is positioned on the ball 12 having the first member 18 conforming to a curvature of the outer surface 15 of the ball 12.

Each of the first end 20 and the second end 22 extends beyond an equator of the ball 12. Additionally, the first end 20 is spaced from the second end 22 a distance is less than a diameter of the ball 12. In this way the first member 18 is inhibited from being removed from the ball 12. The first member 18 has an outwardly facing surface 28 with respect to the ball 12.

A pair of first bearings 30 is provided and each of the first bearings 30 is rotatably positioned between the first member 18 and the outer surface 15 of the ball 12. Thus, the first member 18 is spaced from the ball 12 and the ball 12 rotates freely in the first member 18. Each of the first bearings 30 is aligned with an associated one of the first end 20 and the second end 22. Each of the bearings may be ball bearings or the like.

A pair of second members 32 is coupled to and extends laterally away from an associated one of the first 24 and second 26 lateral edges of the first member 18. Each of the second members 32 is oriented at an angle with the first member 18 and each of the second members 32 has a distal end 34 with respect to the first member 18. Moreover, each of the second members 32 is concavely arcuate between the first member 18 and the distal end 34. Thus, each of the second members 32 conforms to the curvature of the ball 12. The distal end 34 of each of the second members 32 is directed toward the first end 20 of the first member 18. Moreover, the distal end 34 corresponding to each of the second members 32 extends beyond the equator of the ball 12.

A pair of second bearings 36 is provided and each of the second bearings 36 is rotatably coupled between an associated one of the second members 32 and the outer surface 15 of the ball 12. Thus, each of the second members 32 is spaced from the ball 12. Each of the second bearings 36 is aligned with the distal end 34 of the associated second member 32. Each of the second bearings 36 may be ball bearings or the like.

A pair of third members 37 is provided and each of the third members 37 is coupled to and extends laterally away from an associated one of the first 24 and second 26 lateral edges of the first member 18. Each of the third members 37 is oriented at an angle with the first member 18 and each of the third members 37 has a distal end 38 with respect to the first member 18. Each of the third members 37 is concavely arcuate between the first member 18 and the distal end 38 of the third members 37. Thus, each of the third members 37 conforms to the curvature of the ball 12. The distal end 38 of each of the third members 37 is directed toward the second end 22 of the first member 18. Moreover, the distal end 38 corresponding to each of the third members 37 extends beyond the equator of the ball 12.

A pair of third bearings 40 is provided and each of the third bearings 40 is rotatably coupled between an associated one of the third members 37 and the outer surface 15 of the ball 12. Thus, each of the third members 37 is spaced from the ball 12. Each of the third bearings 40 is aligned with the distal end 38 of the associated third member 36. Each of the third bearings 40 may comprise ball bearings or the like.

A pair of pegs 42 is provided and each of the pegs 42 is coupled to and extends outwardly from the outwardly facing surface 28 of the first member 18. Each of the pegs 42 is aligned with an associated one of the first 20 and second 22 ends of the first member 18. A pair of pedals 44 is provided and each of the pedals 44 has a first edge 46 and a first surface 48. The first edge 46 of each of the pedals 44 insertably receives an associated one of the pegs 42. Thus, the first surface 48 corresponding to each of the pedals 44 may have one of a user's feet positioned thereon. In this way the user's feet are spaced from the support surface 14 when the user performs core strengthening exercises.

Each of the pedals 44 is selectively removed from the pegs 42 thereby facilitating each of the pegs 42 to be gripped. A pair of straps 50 is provided and each of the straps has a first end 52 and a second end 54. The first end 52 and the second end 54 of each of the straps 50 are coupled to the first surface 48 of an associated one of the pedals 44. Thus, each of the straps 50 forms a closed loop on the associated pedal 44 to retain the user's feet on the associated pedal 44.

In use, the user's feet are positioned on each of the pedals 44 when the user is lying on the floor to perform core strengthening exercises. The user's feet are elevated from the support surface 14 thereby enhancing resistance when the user performs push-ups. Additionally, the user's feet may urge the ball 12 to roll from side to side on the support surface 14 to perform oblique strengthening exercises. Each of the pedals 44 is selectively removed from the pegs 42 and each of the pegs 42 is gripped. In this way the ball 12 is urged back and forth along the support surface 14 to perform abdominal exercises.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A core strengthening assembly being configured to facilitate a user to perform core strengthening exercises, said core strengthening assembly comprising:

a ball having an equator, said ball being configured to be positioned on a support surface;

a harness being positioned around said ball, said ball rotating freely in said harness, said harness comprising a first member having a first end, a second end, a first lateral edge and a second lateral edge, said first member being elongated between said first and second ends, said first member being concavely arcuate between said first and second ends, said first member being positioned on said ball having said first member conforming to a curvature of an outer surface of said ball, and a pair of second members, each of said second members being coupled to and extending laterally away from an associated one of said first and second lateral edges of said first member, each of said second members being oriented at an angle with said first member, each of said second members having a distal end with respect to said first member, each of said second members being concavely arcuate between said first member and said distal end such that each of said second members conforms to said curvature of said ball; and a pair of pedals, each of said pedals being removably coupled to said harness wherein each of said pedals is configured to have one of a user's feet positioned thereon thereby facilitating the user's feet to be spaced from the support surface when the user performs core strengthening exercises.

2. The core strengthening assembly according to claim 1, further comprising a pair of third members, each of said third members being coupled to and extending laterally away from an associated one of said first and second lateral edges of said first member, each of said third members being oriented at an angle with said first member, each of said third members having a distal end with respect to said first member, each of said third members being concavely arcuate between said first member and said distal end of said third members such that each of said third members conforms to said curvature of said ball.

3. The core strengthening assembly according to claim 2, wherein said distal end of each of said third members being directed toward said second end of said first member, said distal end corresponding to each of said third members extending beyond said equator of said ball.

4. The core strengthening assembly according to claim 3, further comprising a pair of third bearings, each of said third bearings being rotatably coupled between an associated one of said third members and said outer surface of said ball such that each of said third members is spaced from said ball, each of said third bearings being aligned with said distal end of said associated third member.

5. The core strengthening assembly according to claim 1 further comprising a pair of pegs, each of said pegs being coupled to and extending outwardly from said outwardly facing surface of said first member, each of said pegs being aligned with an associated one of said first and second ends of said first member.

6. The core strengthening assembly according to claim 5, wherein each of said pedals has a first edge and a first surface, said first edge of each of said pedals insertably receiving an associated one of said pegs, each of said pedals being selectively removed from said pegs wherein each of said pegs is configured to be gripped.

7. The core strengthening assembly according to claim 6, further comprising a pair of straps, each of said straps having a first end and a second end, said first end and said second end of each of said straps being coupled to said first surface of an associated one of said pedals such that each of said straps forms a closed loop on said associated pedal wherein each of said straps is configured to retain the user's feet on the associated pedal.

8. The core strengthening assembly according to claim 1, wherein said distal end of each of said second members is directed toward said first end of said first member, said distal end corresponding to each of said second members extending beyond said equator of said ball.

9. The core strengthening assembly according to claim 8, further comprising a pair of second bearings, each of said second bearings being rotatably coupled between an associated one of said second members and said outer surface of said ball such that each of said second members is spaced from said ball, each of said second bearings being aligned with said distal end of said associated second member.

10. The core strengthening assembly according to claim 1, wherein each of said first end and said second end extends beyond said equator of said ball, said first end being spaced from said second end a distance being less than a diameter of said ball such that said first member is inhibited from being removed from said ball, said first member having an outwardly facing surface with respect to said ball.

11. The core strengthening assembly according to claim 1, further comprising a pair of first bearings, each of said first bearings being rotatably positioned between said first member and said outer surface of said ball such that said first member is spaced from said ball, each of said first bearings being aligned with an associated one of said first end and said second end.

12. A core strengthening assembly being configured to facilitate a user to perform core strengthening exercises, said core strengthening assembly comprising:

a ball being configured to be positioned on a support surface, said ball having an outer surface;

a harness being positioned around said ball, said ball rotating freely in said harness, said harness comprising:

a first member having a first end, a second end, a first lateral edge and a second lateral edge, said first member being elongated between said first and second ends, said first member being concavely arcuate between said first and second ends, said first member being positioned on said ball having said first member conforming to a curvature of said outer surface of said ball, each of said first end and said second end extending beyond an equator of said ball, said first end being spaced from said second end a distance being less than a diameter of said ball such that said first member is inhibited from being removed from said ball, said first member having an outwardly facing surface with respect to said ball, a pair of first bearings, each of said first bearings being rotatably positioned between said first member and said outer surface of said ball such that said first member is spaced from said ball, each of said first bearings being aligned with an associated one of said first end and said second end, a pair of second members, each of said second members being coupled to and extending laterally away from an associated one of said first and second lateral edges of said first member, each of said second members being oriented at an angle with said first member, each of said second members having a distal end with respect to said first member, each of said second members being concavely arcuate between said first member and said distal end such that each of said second members conforms to said curvature of said ball, said distal end of each of said second members being directed toward said first end of said first member, said distal end corresponding to each of said second members extending beyond said equator of said ball, a pair of second bearings, each of said second bearings being rotatably coupled between an associated one of said second members and said outer surface of said ball such that each of said second members is spaced from said ball, each of said second bearings being aligned with said distal end of said associated second member, a pair of third members, each of said third members being coupled to and extending laterally away from an associated one of said first and second lateral edges of said first member, each of said third members being oriented at an angle with said first member, each of said third members having a distal end with respect to said first member, each of said third members being concavely arcuate between said first member and said distal end of said third members such that each of said third members conforms to said curvature of said ball, said distal end of each of said third members being directed toward said second end of said first member, said distal end corresponding to each of said third members extending beyond said equator of said ball, a pair of third bearings, each of said third bearings being rotatably coupled between an associated one of said third members and said outer surface of said ball such that each of said third members is spaced from said ball, each of said third bearings being aligned with said distal end of said associated third member, and a pair of pegs, each of said pegs being coupled to and extending outwardly from said outwardly facing surface of said first member, each of said pegs being aligned with an associated one of said first and second ends of said first member;

a pair of pedals, each of said pedals having a first edge and a first surface, said first edge of each of said pedals insertably receiving an associated one of said pegs wherein said first surface corresponding to each of said pedals is configured to have one of a user's feet positioned thereon thereby facilitating the user's feet to be spaced from the support surface when the user performs core strengthening exercises, each of said pedals being selectively removed from said pegs wherein each of said pegs is configured to be gripped, and a pair of straps, each of said straps having a first end and a second end, said first end and said second end of each of said straps being coupled to said first surface of an associated one of said pedals such that each of said straps forms a closed loop on said associated pedal wherein each of said straps is configured to retain the user's feet on the associated pedal.

* * * * *